United States Patent [19]

Hartmann et al.

[11] Patent Number: 4,969,436

[45] Date of Patent: Nov. 13, 1990

[54] DIESEL ENGINE INJECTION PUMP GOVERNOR

[75] Inventors: Ernst-Siegfried Hartmann, Overath; Werner Lemme, Rosrath; Heinz W. Fuchs, Remscheid, all of Fed. Rep. of Germany

[73] Assignee: Kloeckner-Humboldt-Deutz AG, Cologne, Fed. Rep. of Germany

[21] Appl. No.: 311,624

[22] Filed: Feb. 16, 1989

[30] Foreign Application Priority Data

Feb. 18, 1988 [DE] Fed. Rep. of Germany ..... 3804958

[51] Int. Cl.[5] ..... F02M 39/00

[52] U.S. Cl. ..... 123/383; 123/366; 123/179 L

[58] Field of Search ..... 123/383, 365, 179 L, 123/366, 382

[56] References Cited

U.S. PATENT DOCUMENTS

| | | | |
|---|---|---|---|
| 2,640,259 | 2/1972 | Garcea | 123/179 L |
| 2,767,700 | 10/1956 | Parks | 123/383 |
| 3,572,304 | 3/1971 | Becker | 123/366 |
| 3,699,941 | 10/1972 | Hughes | 123/366 |
| 3,776,210 | 12/1973 | Beasley | 123/179 L |
| 4,534,329 | 8/1985 | Filtri | 123/383 |
| 4,570,588 | 2/1986 | Herdin | 123/365 |
| 4,640,247 | 2/1987 | Bruning | 123/383 |

FOREIGN PATENT DOCUMENTS

| | | | |
|---|---|---|---|
| 3246869 | 7/1983 | Fed. Rep. of Germany | 123/383 |
| 0120774 | 7/1984 | Japan | 123/383 |

*Primary Examiner*—Carl Stuart Miller

*Attorney, Agent, or Firm*—Charles L. Schwab

[57] ABSTRACT

A governor for injection pumps of diesel internal combustion engines in which the injection amount is controlled by the boost pressure. The governor is mounted directly on the crank casing of the internal combustion engine together with an electromagnet which is energized at startup. The governor and the electromagnet transmit thrust and motion to the control rod of the injection pump through the same lever system. The electromagnet is switched in such a way that it overrides the governor during the engine starting process. The lever system is constructed to produce a nonlinear transmission of the movement of the membrane to the control rod.

12 Claims, 5 Drawing Sheets

DIESEL ENGINE INJECTION PUMP GOVERNOR

TECHNICAL FIELD

This invention relates to a governor for the injection pumps of diesel internal combustion engines in which the amount of injection is controlled according to the boost pressure.

PRIOR ART STATEMENT

In supercharged diesel engines, the injection pump delivery is coordinated with the increased mass of air in the intermediate and high speed ranges. Except in the cases of unit drives, these engines often also run, especially when they are being used as vehicle engines, in a low speed range in which the air delivery is low corresponding to the condition of a naturally aspirated engine. In this operating condition, similar to that of a naturally aspirated engine, the quantity of fuel has to be reduced in order to achieve complete and smoke-free combustion in the specified low speed range.

A governor which is dependent on the boost pressure meets this requirement because it decreases the quantity of fuel for the low speed range.

Governors with boost pressure compensators are commercially available. One such governor uses a diaphragm or membrane which has one side subjected to the boost pressure of the internal combustion engine and the other side biased by a compression spring which is located on an adjustable guide pin bushing. A piston which is disposed within the bushing is connected with a connecting piece and transmits the membrane movement to the control rod of the injection pump. If the membrane is impacted with boost pressure with increasing speed, the connecting piece moves until it contacts a stop screw of a full-load stop device bolted to the pump casing. Thus, the maximum quantity of supply is reached at full loading. During engine starting, a shaft associated with the connecting piece is moved to cause axial movement of the control rod to its start quantity position in which it abuts a stop screw provided specifically for determining the start position. After the starting process has concluded, the shaft and the connecting piece return to their initial positions.

The previously described embodiment is complicated and expensive in its design and, because of its placement, is not suitable without additional expense for subsequent installation on the governor or on the injection pump. The injection pump is adjacent to and mounted on the centrifugal force governor and the boost pressure compensator is mounted on the governor near the pump control rod. This creates extremely crowded conditions making maintenance and adjustment work on these crowded components very difficult.

In addition, the boost pressure compensator has a direct connection to the control rod so that an adjustment of the boost pressure compensator relative to the control rod is not possible.

OBJECTS AND BRIEF SUMMARY OF THE INVENTION

It is a primary object of this invention to equip the injection system of a supercharged diesel engine with a governor that is easy to install, service, repair and replace.

The governor and the boost pressure compensator are assembled as a single unit, together with the electromagnet which is necessary for the starting process, so that the boost pressure compensator can be replaced at little expense. Advantageously, the governor unit is placed on the crank casing side upon which the injection pump is also secured, so the governor can, via a compact relay lever system, have a direct effect on the supply quantity adjustment device of the injection pump. The governor is, advantageously, included together with the electromagnet necessary for starting the engine in such a way that the electromagnet also affects the same relay lever system of the governor. The electromagnet is switched in such a way that, during engine starting, it overrides the governor and sets the injection pump to the desired increased injection start quantity.

A connecting piece is connected in the relay lever system in such a way that the transmission ratio of the membrane movement to the control rod movement is nonlinear. In this way adjustment of the engine smoke curves is possible under a wide range of operating conditions.

In order to also be able to modify the nonlinearity of the transmission ratio with a single component, the connecting piece is provided with several boreholes which are suitable for accepting a pin and, depending upon where the pin is inserted, the transmission ratio to the supply quantity adjustment device can be modified.

In a further embodiment of the invention, the connecting piece can also be easily replaced, since it is secured in the casing of the governor by only one pin and can be replaced at any time with little effort.

In a further embodiment of the invention, the compression spring, which counterbalances the boost pressure on the membrane, is adjusted to an initial prestressed condition by an adjustment mechanism which includes an eccentric adjustment device. In an advantageous way, the eccentric adjustment device exerts force by engaging the sidewalls of an annular groove in the adjustment mechanism so a desired displacement in either opposite direction can be achieved.

The adjustment of the prestressing of the compression spring can be accomplished by an eccentric device which includes a bolt screwed into the casing and having an eccentric pin attached to its inner end engaging the groove of a guide pin bushing which supports the compression spring. This expedient and easily accomplished design is suitable for relatively minor modifications of the elastic force, whereby attention must be paid to assure that the eccentric pin always engages in the groove, so as to set the guide pin bushing in motion toward or away from the membrane. If there is a need for relatively great displacements in both directions to provide the desired spring prestressing, it is advantageous to replace the bolt with a cylindrical component which can be easily rotated and can be held at its outer end against movement by means of a clamping piece attached to the outside of the casing of the boost pressure compensator.

BRIEF DESCRIPTION OF THE DRAWINGS

One embodiment of the invention is illustrated in the drawings in which.

DETAILED DESCRIPTION OF THE DRAWINGS

Figure 1:
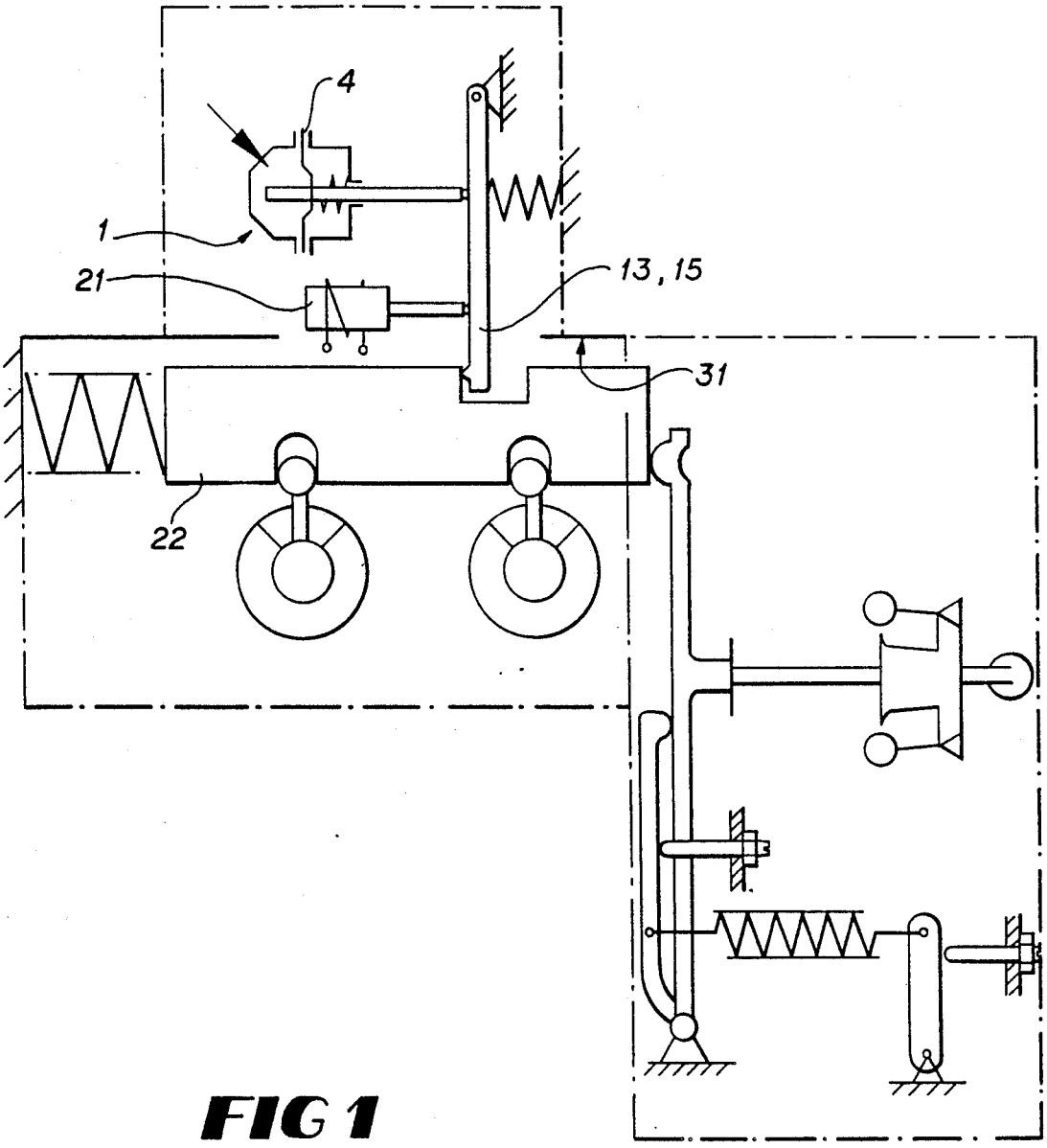
FIG. 1 is a schematic representation of a governor together with an electromagnet for setting fuel delivery at engine starting with the governor secured to the crank casing of an internal combustion engine, whereby both components affect a lever system which moves the control rod of a fuel injection pump.

The injection pump system shown schematically in FIG. 1 includes a governor having a centrifugal force device and a boost-pressure-dependent device which has a start-electromagnet in its casing, whereby both devices have an effect on the rotational position of a lever. The assemblage of both devices is arranged on the engine crank casing in such a way that it engages, via the lever system, the engine's own control rod, which controls the delivery of the injection pump. During engine operation the injection pump is adjusted according to the boost pressure present at the various engine speeds. The electromagnet is controlled in such a way that it overrides the boost pressure setting during the engine starting process.

Figure 2:
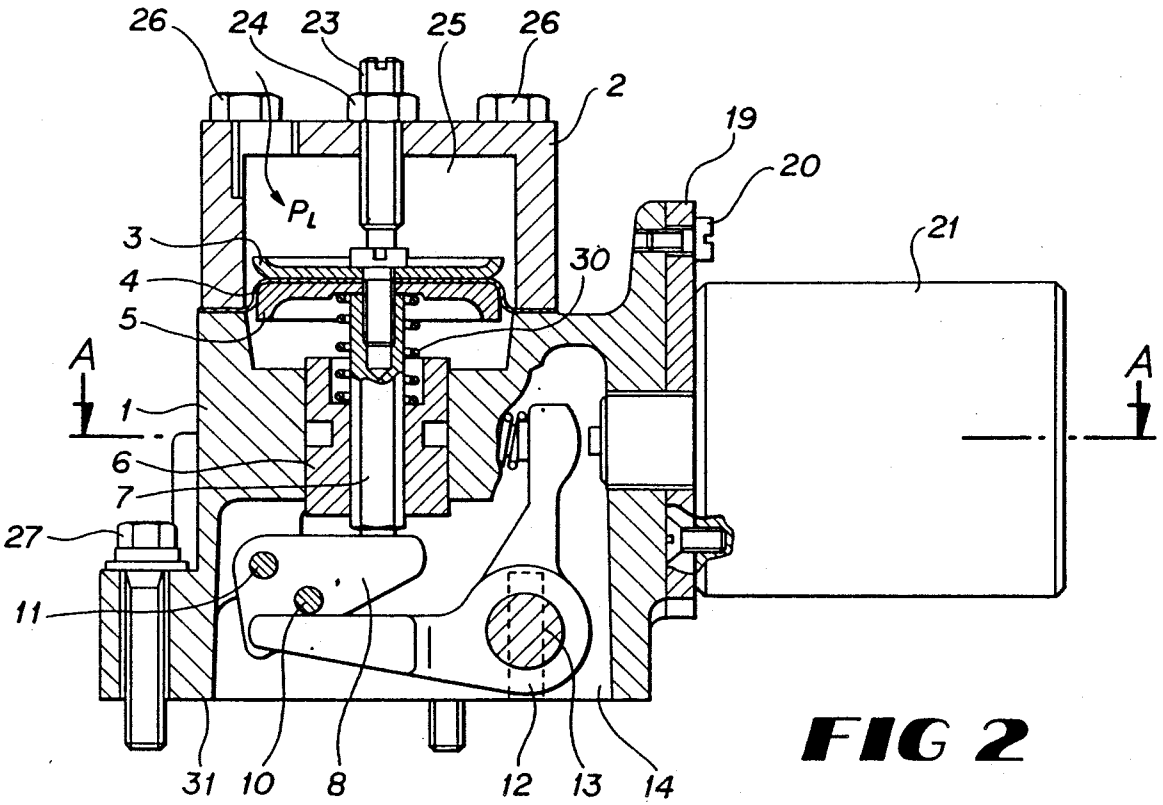
FIG. 2 is a section, taken on the line B—B in FIG. 3, through a governor showing a membrane component acting on a lever system which transmits the effect of the governor as well as the effect of the startup actuated electromagnet to the fuel supply quantity adjustment device.

The governor illustrated in FIG. 2 controls the injection quantity in accordance with the boost pressure of the internal combustion engine. The start electromagnet 21, shown at the right in FIG. 2, has a mounting plate 19 secured thereto by screws and the mounting plate 19 in turn is releasably secured to the casing 1 by cap screws 20. A linear armature component or actuating element of the electromagnet 21 extends through aligned openings in the plate 19 and casing 1 with its inner end in confronting relation to and operable to transmit thrust to one leg of an angular lever 14. During starting of the engine the electromagnet is automatically energized whereby the control rod of the injection pump is actuated, as will be discussed later.

The casing 1 is secured to the engine crank casing by cap screws 27. A casing component 2 is secured by cap screws 26 to the main casing 1 of the governor and holds a flexible membrane 4 in place therebetween. The membrane 4 is positioned between two membrane plates 3 and 5 and is biased axially downward by the supercharged air pressure $P_L$ of the diesel engine via a boost air conducting connection. A piston in the form of a guide pin 7 is secured to and extends downwardly from the lower side of the membrane. As the pin 7 moves up and down with the membrane, it also moves up and down in a guide pin bushing 6 and moves a triangular-shaped connecting piece 8 with which it abuts. A coil type compression spring 30 surrounds he pin 7 and is disposed between the membrane and the guide pin bushing 6. The resilient compression spring 30 can be adjustably prestressed from outside the casing 1. The connecting piece 8 is pivotally supported in the casing 1 by a pivot pin 11 and has several boreholes for receiving a thrust transmitting pin 10. The pin 10 extends through one of the openings in the connecting piece 8 and its opposite ends are in thrust transmitting abutment or engagement with a bifurcated leg of the angular lever 14. Thus, the downward movement of the piston 7 pivots the connecting piece 8 which in turn pivots a shaft 13 journaled in the housing 1. The angular lever 14 is resiliently biased clockwise, as viewed in FIG. 2, by a compression spring 16 which maintains the lever 14 in contact with the pin 10.

Figure 3:
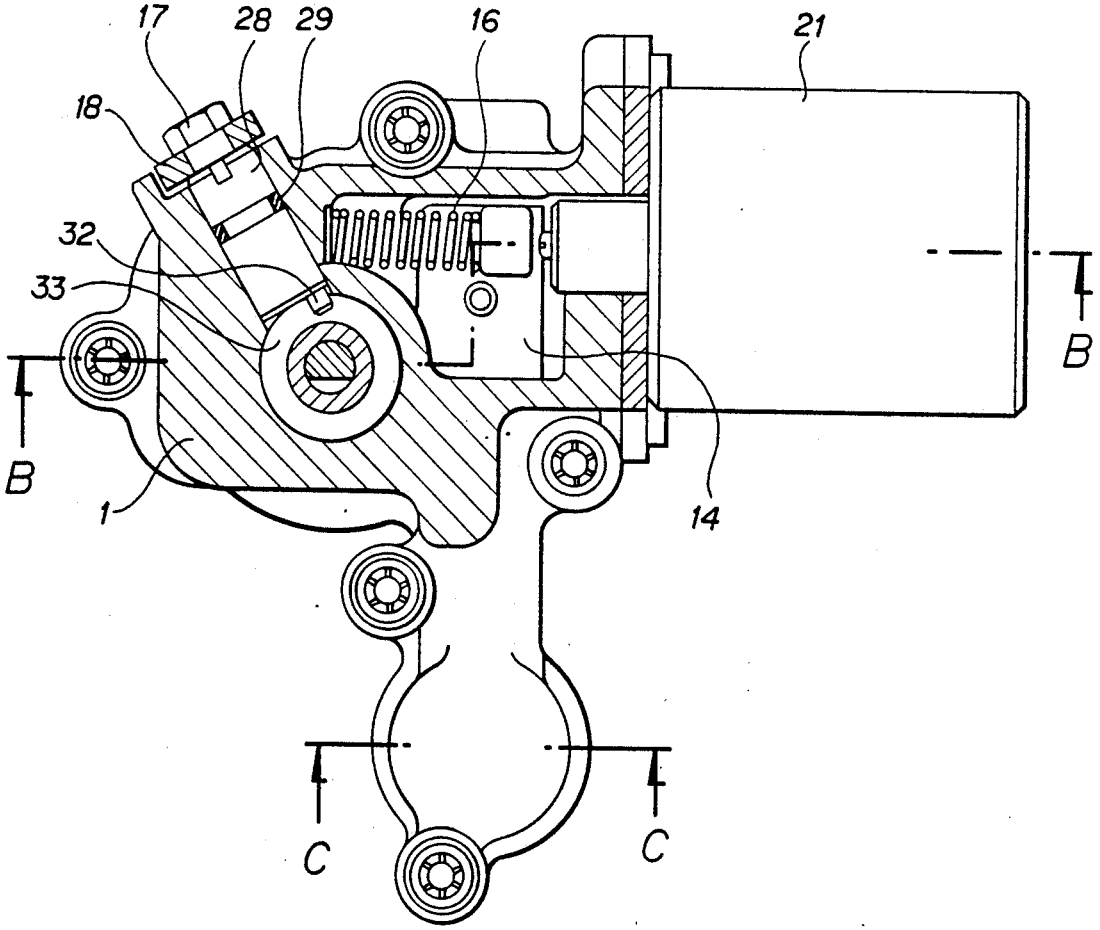
FIG. 3 is a section taken on the line A—A in FIG. 2.

Referring to FIG. 3, the eccentric adjustment device for prestressing the spring 30 includes a cylindrical component 28 which is inserted into a borehole in the casing 1 and includes an annular groove in which an annular seal 29 is disposed. An eccentric pin 32 is attached to the inner end of the component 28 and engages the side walls of an annular groove in the guide pin bushing 6. The guide pin bushing 6 moves axially up or down as the component 28 is rotated by a screw driver engaging the slot 18' (also shown in FIG. 5). Through this rotative movement of the bushing 6 the prestressing of the compression spring 30 can be modified and thus the effective beginning of the boost air pressure movement of the membrane 4 can be changed.

Figure 4:
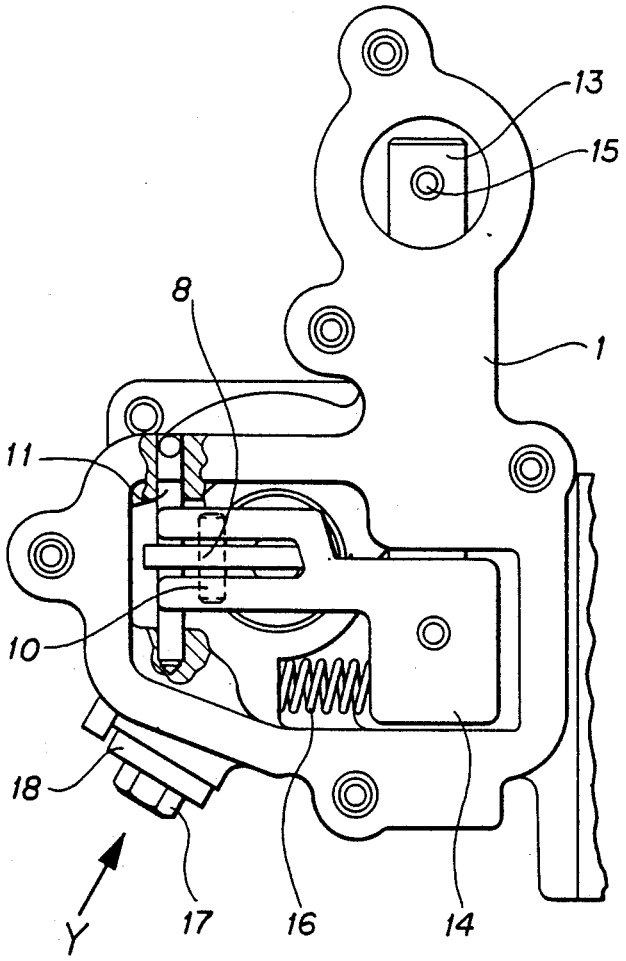
FIG. 4 is a bottom view of the governor shown in FIG. 2.

In FIG. 4 the engaging relation of the lever components is shown wherein the forked legs of the bifurcated end part of the angular lever 14 receive the connecting piece 8 therebetween and are biased downwardly by the pin 10 under the influence of the thrust exerted by the piston 7 on the connecting piece 8. The connecting piece 8 is pivotally supported by the pin 11 in such a way that it can be easily replaced. The connecting piece 8 is provided with several boreholes which accept the pin 10. In this way one can change the transmission ratio of the movement of the membrane relative to the movement of the shaft 13, thus achieving better control of the governor of the injection pump and better engine operation.

Figure 5:
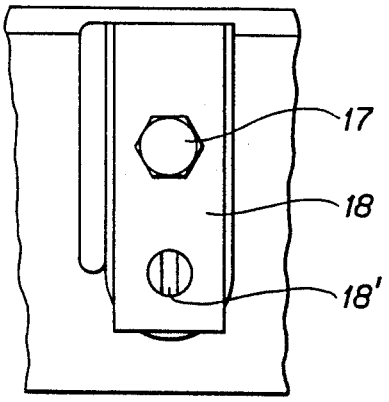
FIG. 5 is a view in the direction of the arrow Y in FIG. 4.

In FIG. 5 the retainer 18 is shown secured to the casing 1 by a cap screw 17 which extends through an opening in the retainer and is screwed into a threaded opening, not shown, in the casing 1. The retainer 18 is in axial thrust transmitting engagement with the outer end of the eccentric component 28 and serves to hold the latter in a selected position of adjustment after the desired prestressing of the compression spring 30 has been set, thereby preventing the eccentric component 28 from being moved by the biasing thrust of the compression spring 30. Upon loosening the cap screw 17, the eccentric component 28 can be rotated by inserting a screw driver through an opening in the retainer and into a slot 18' in the component 28. After adjustment to the desired spring prestressing position, the cap screw 17 is tightened to hold the component 28 in its adjusted position and then the screw driver is withdrawn.

Figure 6:
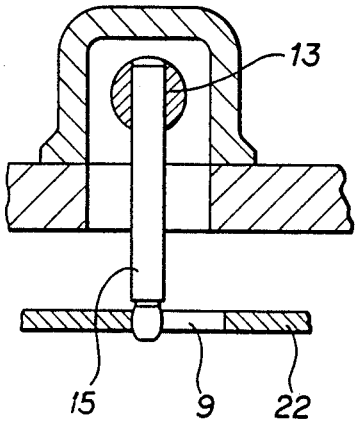
FIG. 6 is a section taken on the line C—C in FIG. 3.

Referring also to FIG. 6 the shaft 13 which, as shown in FIG. 2, is securely connected by a pin 12 to the angular lever 14, is operative to transmit the angular movement of the angular lever 14 to a control rod 22 by a pin 15 secured to the shaft 13. The pin 15 extends into a slot 9 in the control rod 22 of the injection pump whereby the movement of the angular lever 14 is transmitted to the control rod 22 by the pin 15, thereby causing linear movement of the control rod 22.

Figure 7:
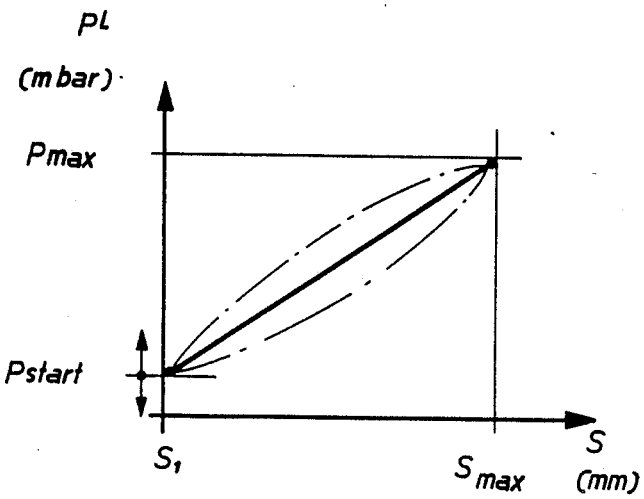
FIG. 7 is a graph showing the curve of the fuel quantity adjustment for the range between the minimum and the maximum boost pressure of the internal combustion engine.

FIG. 7 shows a nonlinear relationship between the boost pressure acting on the membrane and the movement of the control rod between a minimum and a maximum boost pressure. The path or curve can be adjusted to counter the smoking characteristic of different engines by positioning the pin 10 in different holes in the connecting piece 8. The position of the starting point on the P scale can be varied by modifying the prestressing of the spring 30, whereby the movement sensitivity of the membrane to the effective boost pressure can be adjusted.

The angular lever 14 is moved toward its full-load stop position by the movement of the piston 7 which exerts thrust on the connecting piece 8, transmits the thrust through the pin 10 to the angular lever 14 and brings it into a specific full-load stop position. During engine startup the electromagnet is energized and overrides the effect of the governor, thus moving the angular lever 14 and the shaft 13 to such a degree that the control rod 22 of the injection pump is adjusted to effect the maximum fuel supply quantity necessary for starting the engine.

With increasing boost pressure the membrane 4 moves downward against the force of the compression spring 30 and shifts the piston 7 axially downward. The piston 7 exerts thrust on the connecting piece 8 causing it to pivot about its axis (the axis of pin 11) and rotates the angular lever 14 by means of the pin 10 carried by the connecting piece 8. To the same degree, the shaft 13 rotates with the lever 14 as does the pin 15 attached at the end of shaft 13 (FIG. 6). The pin 15 engages directly in a groove 9 in the control rod 22 of the injection pump, whereby the fuel quantity can be controlled dependent upon the boost air pressure of the engine. With the nonlinear path, the injection amount can be adjusted in an economical way to limit engine smoking in all engine operating conditions.

The beginning of the movement phase of the pin 15 can be adjusted easily by changing the prestressing of the compression spring 30.

The embodiments of the invention in which an exclusive property or privilege is claimed are defined as follows:

1. In combination with a supercharged diesel internal combustion engine having a crank casing, a governor for an injection pump in which the quantity of fuel injection is controlled according to the boost pressure, said governor including a casing and a membrane (4) exposed on one of its sides to the pressure of the supercharged air and biased on its other side by a compression spring (30) the prestressing of which is adjusted by a guide pin bushing (6), and said governor moving the delivery quantity adjustment device of the injection pump by means of a lever system, an electromagnet (21) mounted on said governor casing having an actuating element operative to engage and move said lever system at engine startup, said governor and electromagnet being mounted as a unit directly on the crank casing of said engine, whereby the governor and the electromagnet jointly adjust the delivery quantity adjustment device by engaging said lever system, said lever system including a connecting piece (8) having a plurality of boreholes and a pin (10) in one of said boreholes rotatably supporting said connecting piece (8) on said governor casing, said connecting piece (8) transmitting movement of said membrane (4) to said delivery quantity adjustment device.

2. The combination of claim 1 wherein said electromagnet overrides said governor during starting of said engine.

3. The combination of claim 1 wherein said connecting piece (8) transmits the movement of the membrane to the delivery quantity adjustment device of the injection pump in a manner represented graphically as a curve.

4. The combination of claim 3 wherein said electromagnet overrides said governor during starting of said engine.

5. The combination of claim 1 wherein said connecting piece (8) is replaceable.

6. In combination with a supercharged diesel internal combustion engine having a crank casing, a governor for an injection pump in which the quantity of fuel injection is controlled according to the boose pressure, said governor including a casing and a membrane (4) exposed on one of its sides to the pressure of the supercharged air and biased on its other side by a compression spring (30) the prestressing of which is adjusted by a guide pin bushing (6), and said governor moving the delivery quantity adjustment device of the injection pump be means of a lever system, an electromagnet (21) mounted on said governor casing having an actuating element operative to engage and move said lever system at engine startup, said governor and electromagnet being mounted as a unit directly on the crank casing of said engine, whereby the governor and the electromagnet jointly adjust the delivery quantity adjustment device by engaging said lever system, an eccentric component (28) pivotally mounted on said governor casing and having an outer end by which it may be pivotally adjusted from the exterior of said governor casing, said eccentric component (28) including an eccentric pin attached to its inner end cooperatively engaging said guide pin bushing (6) whereby said spring (30) is adjustably prestressed by pivotal adjustment of said eccentric component (28).

7. The combination of claim 6 wherein said lever system includes a connecting piece (8) which transmits the movement of said membrane to said delivery quantity adjustment device of said injection pump in a manner represented graphically as a curve.

8. The combination of claim 7 wherein said connecting piece (8) is replaceable.

9. The combination of claim 6 wherein said guide pin bushing (6) includes an annular circumferential groove and wherein said eccentric pin of the eccentric component (28) extends into said circumferential groove and moves said guide pin bushing axially upon pivotal adjustment of said eccentric component (28).

10. The combination of claim 6 wherein said eccentric component is a bolt which is screwed into the casing.

11. The combination of claim 6 wherein said governor casing includes a cylindrical opening and said eccentric component is a cylindrical component rotatably mounted in said cylindrical opening and further comprising an annular seal (29) between the circumference of said cylindrical component and said cylindrical opening and a retainer releasably secured to said governor casing and disposed in axial thrust transmitting engagement with the outer end of said cylindrical component.

12. The combination of claim 6 wherein said electromagnet overrides said governor during starting of said engine.

* * * * *

UNITED STATES PATENT AND TRADEMARK OFFICE

CERTIFICATE OF CORRECTION

PATENT NO. : 4,969,436

DATED : November 13, 1990

INVENTOR(S) : Ernst Siegfried Hartmann, Werner Lemme, Heinz W. Fuchs

It is certified that error appears in the above-identified patent and that said Letters Patent is hereby corrected as shown below:

Column 6, Line 14, cancel "boose" and substitute "boost"

Column 6, Line 21, cancel "be" and substitute "by"

Signed and Sealed this

Nineteenth Day of May, 1992

*Attest:*

DOUGLAS B. COMER

*Attesting Officer*

*Acting Commissioner of Patents and Trademarks*